US005542710A

United States Patent [19]

Silverschotz et al.

[11] Patent Number: 5,542,710

[45] Date of Patent: Aug. 6, 1996

[54] RECYCLABLE INSTANT SCRATCH OFF LOTTERY TICKET

[75] Inventors: Stanford B. Silverschotz, Livingston; Louis Rua, Jr., Plainsboro; David M. Polunas, S. Bound Brook; Stephen E. Martin, Jamesburg, all of N.J.

[73] Assignee: Webcraft Technologies, Inc., North Brunswick, N.J.

[21] Appl. No.: 126,199

[22] Filed: Sep. 24, 1993

[51] Int. Cl.[6] ..... A63F 3/06

[52] U.S. Cl. ..... 283/94; 283/901; 283/903

[58] Field of Search ..... 283/94, 901, 903, 283/100; 273/269

[56] References Cited

U.S. PATENT DOCUMENTS

| | | | |
|---|---|---|---|
| Re. 34,737 | 7/1994 | Desbiens . | |
| 2,618,866 | 11/1952 | Adams . | |
| 3,602,513 | 8/1971 | Breen . | |
| 3,603,592 | 9/1971 | Bury . | |
| 3,618,231 | 11/1971 | Nason . | |
| 4,037,007 | 7/1977 | Wood . | |
| 4,084,332 | 4/1978 | Waloszyk et al. . | |
| 4,095,824 | 6/1978 | Backman | 283/903 |
| 4,120,445 | 10/1978 | Carrier et al. | 283/903 |
| 4,273,362 | 6/1981 | Carrier et al. . | |
| 4,354,845 | 10/1982 | Poteet et al. . | |
| 4,425,386 | 1/1984 | Chang . | |
| 4,486,033 | 12/1984 | Parotta . | |
| 4,488,646 | 12/1984 | McCorkle . | |
| 4,634,149 | 1/1987 | Donovan | 283/102 |
| 4,677,553 | 6/1987 | Roberts . | |
| 4,725,079 | 2/1988 | Koza et al. | 283/73 |
| 4,726,608 | 2/1988 | Walton . | |
| 4,777,108 | 10/1988 | Adair . | |
| 4,835,624 | 5/1989 | Black . | |
| 4,850,618 | 7/1989 | Halladay, Jr. | 283/903 |
| 4,877,253 | 10/1989 | Arens . | |
| 4,881,758 | 11/1989 | Ben-David . | |
| 4,900,617 | 2/1990 | Smith . | |
| 5,029,901 | 7/1991 | Dotson et al. | 462/8 R |
| 5,058,925 | 10/1991 | Dotson | 283/95 |
| 5,074,566 | 12/1991 | Desbiens | 273/269 |
| 5,083,815 | 1/1992 | Scrymgeour . | |
| 5,106,089 | 4/1992 | Wood . | |
| 5,112,058 | 5/1992 | Sandeen | 273/269 |
| 5,193,815 | 3/1993 | Pollard | 273/269 |
| 5,193,854 | 3/1993 | Borowski, Jr. | 283/87 |
| 5,213,664 | 5/1993 | Hansell | 162/134 |
| 5,217,258 | 6/1993 | Sanderson . | |
| 5,228,692 | 7/1993 | Carrick et al. | 283/901 |
| 5,286,061 | 2/1994 | Behn . | |

FOREIGN PATENT DOCUMENTS

| | | |
|---|---|---|
| 224966 | 11/1990 | United Kingdom . |

*Primary Examiner*—Hwei-Siu Payer

*Attorney, Agent, or Firm*—Shlesinger Arkwright & Garvey

[57] ABSTRACT

A piece of printed material has preprinted, hidden data and includes a structure which prevents premature revealing of the hidden data. For example, an instant scratch-off lottery ticket according to the invention includes a substrate, an ink layer disposed on the substrate, the ink layer including hidden lottery data. An elemental-metal-free ink-receptive layer is provided between the ink layer and the substrate, whereby the metal-free layer prevents migration of ink from the ink layer through the substrate when the substrate has been contacted with a solvent.

20 Claims, 2 Drawing Sheets

RECYCLABLE INSTANT SCRATCH OFF LOTTERY TICKET

FIELD OF THE INVENTION

This invention relates to the physical structure of multi-layered printed matter. In particular, this invention relates to lottery tickets of the instant scratch-off type, and even more particularly to means for maintaining the security of the covered game data in instant scratch-off lottery tickets constructed to permit recycling into other paper products.

BACKGROUND OF THE INVENTION

Instant scratch-off lottery tickets are being increasingly sold by government and charitable entities around the world as sources of revenue.

Instant scratch-off lottery tickets contain hidden pre-printed winning and losing game data which distinguishes this form of lottery from the various other forms in which winning numbers are drawn some time after the sale of the ticket. The growth of popularity of instant scratch-off lottery with the public is explained by the public's ability to immediately learn if the ticket is a winner or loser. The increasing popularity with the governmental and charitable entities is explained by the advantage of knowing in advance the precise number of winners and the total value of the winnings when an entire lot of tickets will have been sold.

Because of the growth in the use of instant scratch-off lottery tickets, concern has arisen as to impact of large quantities of the tickets on the environment, particularly when discarded to eventual landfill. This concern was heightened because the conventional physical structure of instant scratch-off lottery tickets includes a thin layer of aluminum foil which renders used tickets and waste that occurs during the manufacture of instant scratch-off lottery tickets non-recyclable to paper products. The aluminum foil along with certain printed and coated elements was heretofore essential in instant scratch-off lottery tickets to prevent premature disclosure of winning and losing tickets by one of several non-damaging techniques. The possibility of such premature disclosure must be prevented in order to maintain the integrity of the lottery and acceptability of the lottery ticket to the public.

Prevention of non-damaging premature disclosure of winning and losing tickets is of great importance in instant scratch-off lottery tickets because the tickets are generally sold through retail dealers who may have access to groups of tickets over periods of several days prior to sale. In such time periods it could be possible, if not prevented by technological means, that a dealer could select losers for sale to the public and winners for his own disposition. Known destructive means of premature game data disclosure do not generally threaten the integrity of instant scratch-off lottery tickets because these techniques reveal tampering and render the tickets generally unsaleable.

The conventional structure of instant scratch-off lottery tickets is based on aluminum clad cardboard. The aluminum cladding is usually of the order of 0.0003 inches in thickness adhered to cardboard stock typically of 0.010 inches in thickness. The surface of the aluminum normally must be treated to accept conventional printing inks for the decorative and thematic promotional purposes of the lottery, but also for surface compatibility with variable computer controlled printing of game data with one or more of the several available variable printing means such as digital controlled laser-xerography; digital controlled ink-jet; digital controlled light emitting diode xerography; and digital controlled ion deposition printing.

In the conventional structure, the variably printed game data is covered by one or more of coatings designed to protect the game data from premature disclosure. These coatings include a first transparent varnish overlay of the game data to provide slip for the coin or other object used to scratch off a covering opaque composite coating of filled rubber which in turn may be coated or printed with decorative and thematic patterns or images.

The normal inclusion of a layer of thin aluminum foil was intended to prevent premature reading of the game data by several principal non-destructive methods.

One non-destructive method prevented by the aluminum foil was the use of a strong light shone through the front of the ticket or as a mirror image viewed from the back of the ticket.

A second non-destructive method prevented by the foil was the delamination of the cardboard ticket by carefully separating the layer of paper first beneath the surface on which the game data is printed and then viewing the game data through this layer. By using aluminum foil as the layer on which the game data was printed such candling became impossible.

Early in the development of instant scratch-off lottery tickets the aluminum foil was believed necessary to diffuse soft X-rays. However, X-ray detection of the game data became virtually impossible due to the use of ink-jet inks of little or no detectable radio opacity. Heavy clay coatings on the cardboard surface have defeated the technique in which the top layer of paper is delaminated and the game data viewed from below. See U.S. Pat. No. 5,213,664 to Hansell. Accordingly, the need for an aluminum foil layer has been obviated by the use of low radio-opacity ink-jet type ink for the variable printing of the game data, and by the use of dense clay coatings on the surface of the cardboard base material.

The various candling techniques for non-destructive premature reading of game data have also been defeated by the use of confusion patterns preferably printed beneath thematic overprints. Confusion patterns may also be printed on the cardboard surface beneath an opaque white layer when such opaque layers are used.

However, there remains to be defeated, the non-destructive technique of causing the migration of the ink of ink-jet printed game data through various printed and coated underlayers and through a non-metal clad cardboard when the rear surface is wetted by a pad of absorbent materials such as paper toweling or paper napkin saturated with water or with water and water miscible solvents pressed against the rear side of the ticket. Variations of this basic technique include application of heated surfaces and variations in solvent constituents to a saturated paper towel or napkin to accelerate ink-jet ink migration. It has heretofore been the case that with this wet pad technique, a readable image of the game data can be transferred to the paper towel or napkin without causing residual evidence of tampering, once the lottery ticket has dried.

OBJECTS AND SUMMARY OF THE INVENTION

It is an object of the invention to provide a piece of printed material having hidden, preprinted data, that overcomes the problem of prior art devices.

It is another object of the invention to provide printed material having concealed preprinted data which securely prevents the unauthorized, premature revealing of such hidden data.

It is yet another object of the invention to provide a piece of multilayered printed matter, particularly suited for scratch-off type lottery tickets.

It is yet another object of the invention to provide a lottery ticket having no metal foil layers, such as elemental aluminum, yet the structure of which prevents premature revealing of hidden, preprinted data.

It is yet a still further object of the invention to provide a scratch-off type lottery ticket in which the hidden data is printed with an ink having minimal radio opacity.

It is a further object of the invention to eliminate the thin aluminum foil layer incorporated on conventionally structured cardboard based instant scratch-off lottery tickets and yet prevent the premature disclosure of printed game data.

It is an object of this invention to provide a lottery ticket with a structure that defeats all of the known non-destructive techniques of premature game data disclosure in a non-metal clad cardboard instant scratch-off lottery ticket suitable for recycling into other paper products.

It is a further object of the invention to provide a lottery ticket with a structure that defeats the wet pad technique of premature game-data disclosure.

In summary, the present invention discloses a novel piece of printed matter which prevents premature disclosure of hidden, preprinted data.

The terms "instant scratch-off lottery ticket" and "instant scratch-off game ticket" are used for convenience only. It is to be understood that our invention includes all type of printed material for which secure, preprinted hidden data is required. For example, it is expected that the features of our invention will be used to make more secure the preprinted, hidden control numbers on printed materials, such as manufacturer's discount coupons, food stamps, and bank security instruments, for example.

DETAILED DESCRIPTION OF THE INVENTION

Figure 1:
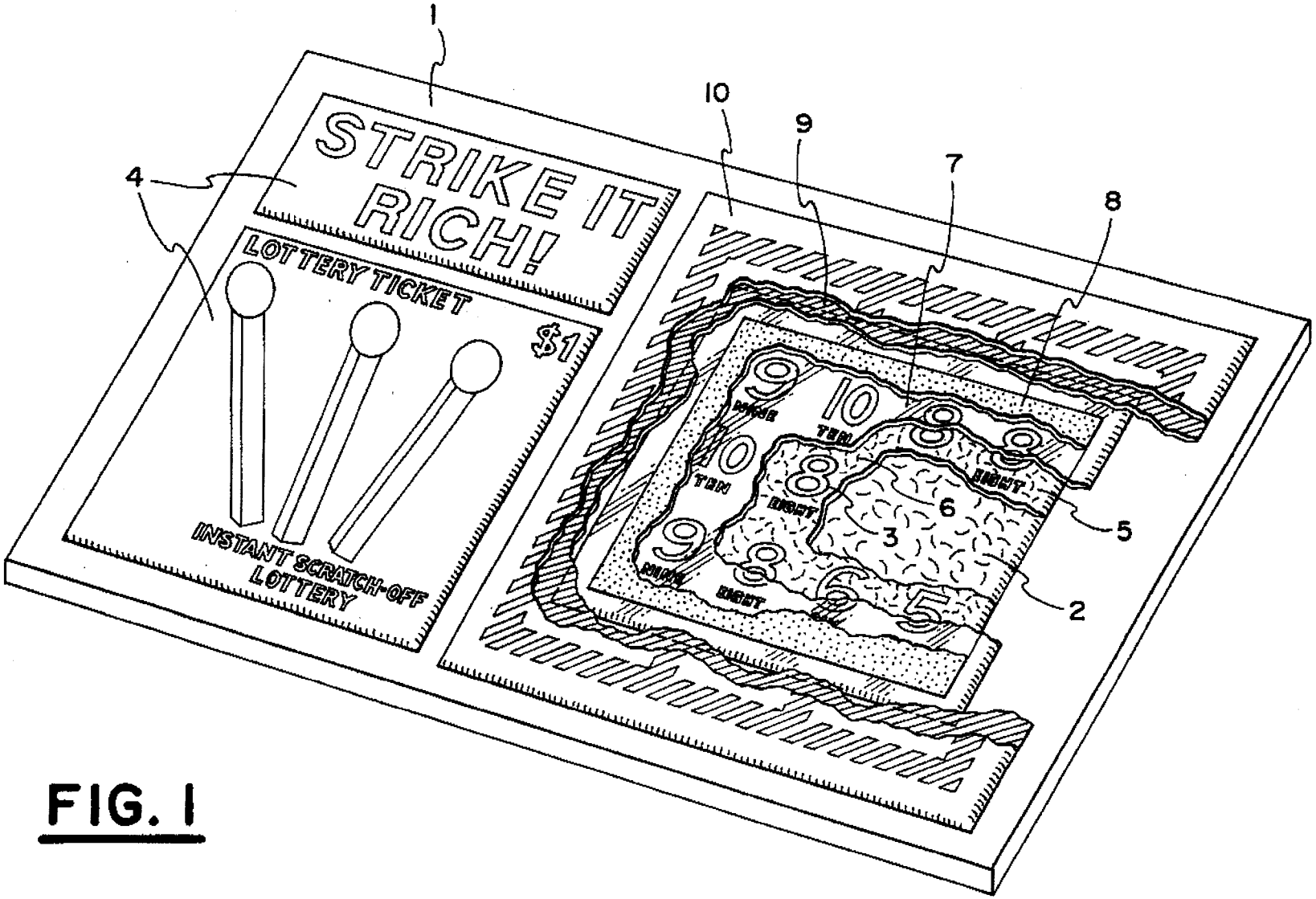
FIG. 1 is a perspective cutaway view of an instant scratch-off lottery ticket according to the invention showing the various layers in the game play area.
Figure 2:
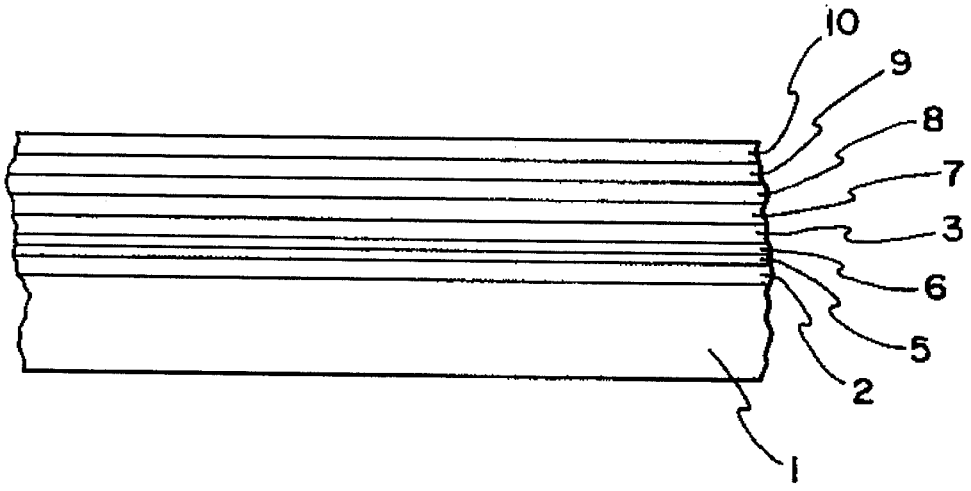
FIG. 2 is a schematic, cross-sectional view of the preferred embodiment of FIG. 1.

Referring to FIGS. 1 and 2, the instant scratch-off lottery ticket is formed on a cardboard base 1 on the surface of which a Benday pattern 2 is first printed, usually in the same step in the printing process that the thematic game graphics 4 are also printed.

The purpose of the Benday pattern is to inconvenience a counterfeiter who would wish to cut out indicia from the game play area of a ticket and replace the same with indicia from another non-winning ticket to cause the first lottery ticket to appear to be a winner. The varying Benday lines (shown in FIG. 1), would tend to prevent the counterfeiter from cutting indicia from one ticket and adding it to another because the relative positions of Benday lines and overlying indicia vary from lottery ticket to lottery ticket and the discontinuity of Benday lines would be obvious to the redeeming agent. As best shown in FIG. 1, Benday pattern 2 is preferably in the form of short curved lines.

The Benday pattern is confined to the game play area, in which ink-jet printed game numerals or game-play data 3 are shown by example in FIG. 1. The thematic graphics 4 and the Benday pattern 2 are printed by conventional means such as lithographic, flexographic, or gravure techniques. The Benday pattern 2 is covered by a thin layer of a translucent white ink 5, but it is essential that a thin translucent ink-jet receptive layer 6 either cover the translucent white ink 5 or directly cover the Benday pattern 2 (as in the embodiment of FIG. 3, described below). The purpose of the translucent white ink 5 is to provide sufficient contrast to the ink-jet produced game-play data which by convention is normally black or deep grey.

It is expected that the material for the translucent ink-jet receptive layer be selected to have minimum radio opacity for hindering unauthorized detection of hidden data by x-ray detection methods.

Each of these layers is dried prior to the application of the subsequent layer. Once these layers have been applied and dried, the game-play data or images 3 are printed onto the receptive layer 6 by ink-jet printing means.

The ink-jet printed game-play data 3 is then covered by at least one layer of a clear varnish 7 and a layer of scratch-off material 8 such as Craigseal product 2850-HD manufactured by Craig Adhesives Corp., Newark, N.J. The clear varnish 7 acts to prevent damage to the game-play data 3 when the scratch-off material 8 is removed by lottery players. The scratch-off material 8 itself is over-printed with an optical confusion pattern 9 that is covered and hidden by over printed thematic graphics 10.

The overprinted thematic graphics 10 and the optical confusion pattern 9 are destroyed when a lottery player removes the scratch-off compound 8.

Figure 3:
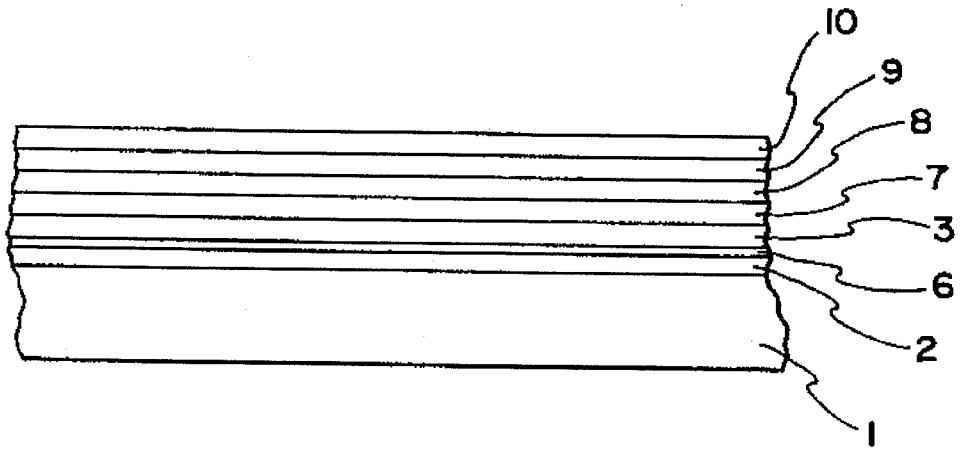
FIG. 3 is a schematic, cross-sectional view, similar to FIG. 2, of another preferred embodiment of the invention.

FIG. 3 illustrates another preferred embodiment of the invention. By control of the translucency and color of the ink-jet receptive layer 6 it is possible to eliminate the need for the underlying translucent white ink 5 of the embodiment of FIGS. 1 and 2. To achieve this desirable elimination, it is necessary that the ink-jet receptive layer 6 be sufficiently translucent to reveal the underlying Benday pattern 2 and yet supply sufficient contrast to the ink-jet produced game-play data 3 which by convention is normally black or deep gray.

Additionally, we have found that by controlling the composition and thickness of the ink-jet receptive layer 6 we can obtain an instant scratch-off lottery ticket that resists the migration of the ink-jet produced game-play data 3 through the ticket under the influence of any known wet pad technique, such as described above, to the point that readable migrated ink-jet patterns do not occur prior to obvious ticket destruction owing to swelling and delamination of the ticket that does not recover after drying.

We have found the receptive layer 6 to be effective when applied as an ink by either flexographic, gravure or silk screen techniques to a thickness of 0.0025 to 0.005 inches independent of whether an underlying white ink 5 is used, and when the receptive layer ink is composed of finely divided fillers thoroughly mixed into a resinous binder and adjusted for viscosity with organic solvents.

The proportions of these ingredients are set forth in TABLE 1 for flexographic, gravure and silk screen applications.

TABLE 1 is a chart showing proportions of ingredients required to prepare an ink-jet receptive coating for either flexographic, gravure or silk screen application.

TABLE 1

| | INK-JET RECEPTIVE FORMULATIONS | | |
|---|---|---|---|
| | FLEXOGRAPHIC | GRAVURE | SILKSCREEN |
| FILLER: Mixtures of finely divided clay, silica, titanium dioxide, calcium carbonate. | 20–40% | 17.5–35.5% | 21–42% |
| THERMOPLASTIC RESIN VEHICLE: acrylic or polyester or polyamide | 70–50% | 62.5–44.5% | 74–53% |
| SOLVENT: AROMATIC/ ALIPHATIC MIXTURE OF n-propanol ethanol VM&P naptha propyleneglycolmethylether | 10–12% | 20–25% | 5–10% |

VM&P naptha is the standard term in the trade for Varnish Maker's and Painter's naptha.

Surprisingly, we have found that in addition to providing the benefit of a structure that prevents premature game data disclosure, these compositions of the receptive layer set forth in TABLE 1 enhance the appearance of the ink-jet fonts by causing a slight feathering of the images' individual droplets into the images of adjacent droplets.

In use, we have found that titanium dioxide based white inks provide good results.

It is likewise contemplated that the receptive layer contains particles of titanium dioxide, calcium carbonate, and the like.

It is contemplated that the ink-jet receptive layer contain particles of compounds of sufficient surface energy or surface tension to hinder leaching of the ink-jet inks.

It is also expected that the ink-jet ink be selected to have minimum radio opacity for hindering unauthorized detection of hidden data by x-ray detection methods.

It is also contemplated that an opaque clay coated surface 12 be provided on the cardboard substrate (see FIGS. 2 and 3).

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. An instant scratch-off lottery ticket with improved security, comprising:

a) a substrate including a cardboard with an opaque, clay-coated surface;

b) an ink layer disposed on said substrate, said ink layer defining lottery data;

c) a scratch-off material layer disposed over said ink layer; and d) a substantially elemental-metal-free ink-receptive layer disposed between said ink layer and said substrate, said substantially elemental-metal-free ink-receptive layer comprising an ink-jet receptive layer containing particles of calcium carbonate and being compounded and selected for preventing migration of ink from said ink layer through said substrate when said substrate has been contacted with a solvent.

2. An instant scratch-off lottery ticket as defined in claim 1, wherein:

a) said ink layer includes an ink-jet ink.

3. An instant scratch-off lottery ticket as defined in claim 1, wherein:

a) said ink layer includes an ink having low radio opacity.

4. An instant scratch-off lottery ticket as defined in claim 1, wherein:

a) a Benday pattern is disposed between said substrate and said ink layer.

5. An instant scratch-off lottery ticket as defined in claim 4, wherein:

a) said ink-receptive layer is disposed between said Benday pattern and said ink layer; and b) said ink-receptive layer permits the viewing of said Benday pattern layer when said scratch-off material layer has been removed.

6. An instant scratch-off lottery ticket with improved security, comprising:

a) a substrate including a cardboard having an opaque, clay-coated surface thereon;

b) an ink layer disposed on said substrate, said ink layer defining lottery data;

c) a scratch-off material layer disposed over said ink layer; and d) a substantially elemental-metal-free ink-receptive layer disposed between said ink layer and said substrate, said substantially elemental-metal-free ink-receptive layer being compounded and selected for preventing migration of ink from said ink layer through said substrate when said substrate has been contacted with a solvent.

7. An instant scratch-off lottery ticket as defined in claim 6, wherein:

a) said ink-receptive layer includes an ink-jet receptive layer containing particles of titanium dioxide.

8. An instant scratch-off lottery ticket as defined in claim 6, wherein:

a) said ink-receptive layer comprising an ink-jet receptive layer containing particles of calcium carbonate.

9. An instant scratch-off lottery ticket as defined in claim 6, wherein:

a) said ink layer includes an ink having low radio opacity.

10. An instant scratch-off lottery ticket as defined in claim 6, wherein:

a) a Benday pattern is disposed between said substrate and said ink layer.

11. An instant scratch-off lottery ticket with improved security, comprising:

a) a substrate;

b) a substantially translucent ink-receptive layer disposed on said substrate for absorbing and preventing migration of ink toward said substrate;

c) a substantially translucent white ink layer disposed between said substrate and said substantially translucent ink-receptive layer; and d) a scratch-off material layer disposed over said translucent ink-receptive layer.

12. An instant scratch-off lottery ticket as defined in claim 11, wherein:

a) a Benday pattern is disposed on said substrate.

13. An instant scratch-off lottery ticket as defined in claim 12, wherein:

said substantially translucent white ink layer is disposed between said Benday pattern and said ink-receptive layer.

14. An instant scratch-off lottery ticket with improved security, comprising:

a) a substrate;

b) a substantially translucent ink-receptive layer disposed on said substrate;

c) a substantially translucent white ink layer disposed between said substrate and said substantially translucent ink-receptive layer; and d) a scratch-off material layer disposed over said translucent ink-receptive layer.

15. An instant scratch-off lottery ticket with improved security, comprising:

a) a substrate having a Benday pattern disposed thereon;

b) a substantially translucent ink-receptive layer disposed on said substrate;

c) a substantially translucent white ink layer disposed between said Benday pattern and said ink-receptive layer; and d) a scratch-off material layer disposed over said translucent ink-receptive layer

16. An instant scratch-off lottery ticket with improved security, comprising:

a) a substrate;

b) a substantially translucent ink-receptive layer disposed on said substrate for absorbing and preventing migration of ink defining the game data toward said substrate;

c) a scratch-off material layer disposed over said translucent ink-receptive layer;

d) a Benday pattern disposed on said substrate;

e) a substantially translucent white ink layer disposed between said Benday pattern and said ink-receptive layer.

17. A method of producing an instant scratch-off lottery ticket, comprising the steps of:

a) providing a substrate including a cardboard with an opaque, clay-coated surface;

b) providing a substantially metal-free ink receptive layer on the substrate, said ink-receptive layer containing particles of calcium carbonate;

c) providing an ink layer on the substantially metal free ink-receptive layer; and d) providing a scratch-off material on the ink layer.

18. A method of producing an instant scratch-off lottery ticket as defined in claim 17, wherein:

a) said step of providing an ink layer is carried out by ink-jet printing.

19. A method of producing an instant scratch-off lottery ticket as defined in claim 17, wherein:

a) said step of providing an ink layer includes printing with an ink having low radio opacity.

20. A method of producing an instant scratch-off lottery ticket as defined in claim 17, further comprising the step of:

a) printing a Benday pattern on the substrate.

* * * * *